United States Patent [19]

Jones et al.

[11] Patent Number: 4,619,669

[45] Date of Patent: Oct. 28, 1986

[54] METHOD FOR INCREASED MINE RECOVERY AND UPGRADING OF LIGNITE

[75] Inventors: Elvis E. Jones, Lake Jackson; Terry A. Pearce, Lake Jackson; Dacon C. Laird, III, Lake Jackson; James H. Everitt, Fairfield, all of Tex.

[73] Assignee: The Dow Chemical Company, Midland, Mich.

[21] Appl. No.: 674,382

[22] Filed: Nov. 23, 1984

[51] Int. Cl.[4] ..... C10L 9/00; B03B 5/60

[52] U.S. Cl. ..... 44/1 G; 209/173

[58] Field of Search ..... 44/1 G, 1 C; 209/173

[56] References Cited

U.S. PATENT DOCUMENTS

| | | | |
|---|---|---|---|
| 4,052,168 | 10/1977 | Koppelman | 44/1 G |
| 4,395,334 | 7/1983 | Nakabayashi et al. | 44/1 G |
| 4,403,996 | 9/1983 | Matsuura et al. | 44/1 G |

OTHER PUBLICATIONS

Coal Desulfurization Prior to Combustion, Eliot, "EPA Studies of Coal Quality and Cleanability, Noyes Data Corp. Park Ridge, NJ, 1978, pp. 103–106.

*Primary Examiner*—Carl F. Dees
*Attorney, Agent, or Firm*—M. W. Barrow

[57] ABSTRACT

A method is disclosed for upgrading run-of-the-mine (ROM) lignites to remove the gangue (clays, rock etc.) which form ash when the lignite is burned. The unique features of the process, a combination of unit operations in a specified sequence, result in less loss of combustible fuel value without hydrodegradation (the production of a large volume of fines) normally associated with contact of the lignite with water as in pipeline transport of lignite.

1 Claim, 3 Drawing Figures

METHOD FOR INCREASED MINE RECOVERY AND UPGRADING OF LIGNITE

BACKGROUND OF THE INVENTION

Present day lignite mining techniques include, in addition to overburden removal, the removal of about four (4) inches of the top of a vein and a leaving of about the bottom four (4) inches of the vein to reduce the clay, rock and sand content, commonly referred to as gangue, mixed with these two portions of the vein. Such practice virtually eliminates the production of lignite from thin veins and results in significant losses of lignite in the two four (4) inch throwaways.

Apparently little effort has been expended in studying means to upgrade lignite. Power plants which use lignite are typically located near the mine site and use run-of-mine (ROM) center cut lignite containing the entrained gangue and ash producing constituents yielding a low overall BTU content and considerable ash disposal. DOE has published the results of a washability study in PMTC-5(79) and several companies have allegedly made a washability study, but none has reported any effort to scale up a plant to use the data obtained in these studies.

Several studies, reported in the literature, relative to the potential for pipeline transport of lignite have noted that the ROM lignite ground to a size to be so transported undergoes a hydrodegradation during pumping studies.

One such study was conducted by the Bureau of Mines, (Bureau of Mines Report of Investigation 5404, 1958), the equipment used in this study was modified from that used in the ASTM jar-tumbler test for coal.[1] The jars were 8-inch lengths of 8-inch pipe with 3 full-length, equally spaced, 1-inch-high longitudinal lifters welded to the inside. As in the ASTM tests, the jars were rotated on horizontal, longitudinal axes at 40 r.p.m. Individual tests were conducted by placing 500 grams of lignite and 1,000 cc of water in a jar, tumbling it for definite periods of time (7 to 64 hours), and determining the size analysis of the tumbled slurry. Size analysis was determined by wet screening the slurry over 4-, 8-, 16-, 30-, and 50-mesh screens and determining the size consist of the minus-50-mesh fraction in a Palo-Travis particle-size apparatus. Degradation was obtained by comparing the size analysis of the tumbled slurry with the similarly determined size analysis of an untumbled sample of the same material.

[1]American Society for Testing Materials, Standard Method of Tumbler Test for Coal: ASTM Standards, D-441-45, pt. 5, 1949, pp. 629–632.

Two series of jar-tumbler tests were run on Sandow (Texas) lignite—one on a ⅛- by 0-inch and the other on the ¼- by 0-inch size ranges. The report noted that both sizes exhibited a considerable amount of degradation, characterized by the formation of large amounts of ultrafine material (5 to 10 microns). In these tests the ¼- by 0-inch lignite apparently suffered less degradation than did the ⅛- by 0-inch; the ¼- by 0-inch had a slightly greater size stability and significantly lower increases in percentage of minus −200-mesh material.

To determine the variability in degradation characteristics of different lignites, a series of additional jar-tumbler tests was run with 4 Texas lignites—each in 3 size ranges (⅛- by 0-, ¼- by 0-, an ½- by 0-inch). These tests were less comprehensive than the tumbler tests on the Sandow lignite, and only the amounts of minus-50-mesh material were determined. The test results showed significant differences in the rates of generating minus-50-mesh material of the various lignites and of different size ranges of the same lignite. For the 3 size ranges, the average rate of increase in minus-50-mesh material of the Titus County lignite was roughly 1.7 times that of the Rusk County lignite. It is interesting to note that the ratios between the hourly rates of increase in percentages of minus-50-mesh material of the 3 size ranges were relatively constant; the hourly increases in percentage of minus-50-mesh material by the ⅛- by 0-and ½- by 0-inch sizes averaged, respectively, 0.564 and 1.244 times that of the ¼- by 0-inch sizes. Such data indicates there is significant hydrodegradation on contact of the lignite with water in jar tumbler tests.

THus, it was unexpected that lignite could be treated with water and the lignite separated from the gangue in an economical manner which permitted use of the normal "throwaway" portion of a vein and even the ability to mine thin veins, which carried some overburden and underburden, to upgrade the lignite and in many instances produce a pumpable slurry.

BRIEF DESCRIPTION OF THE INVENTION

Figure 1:
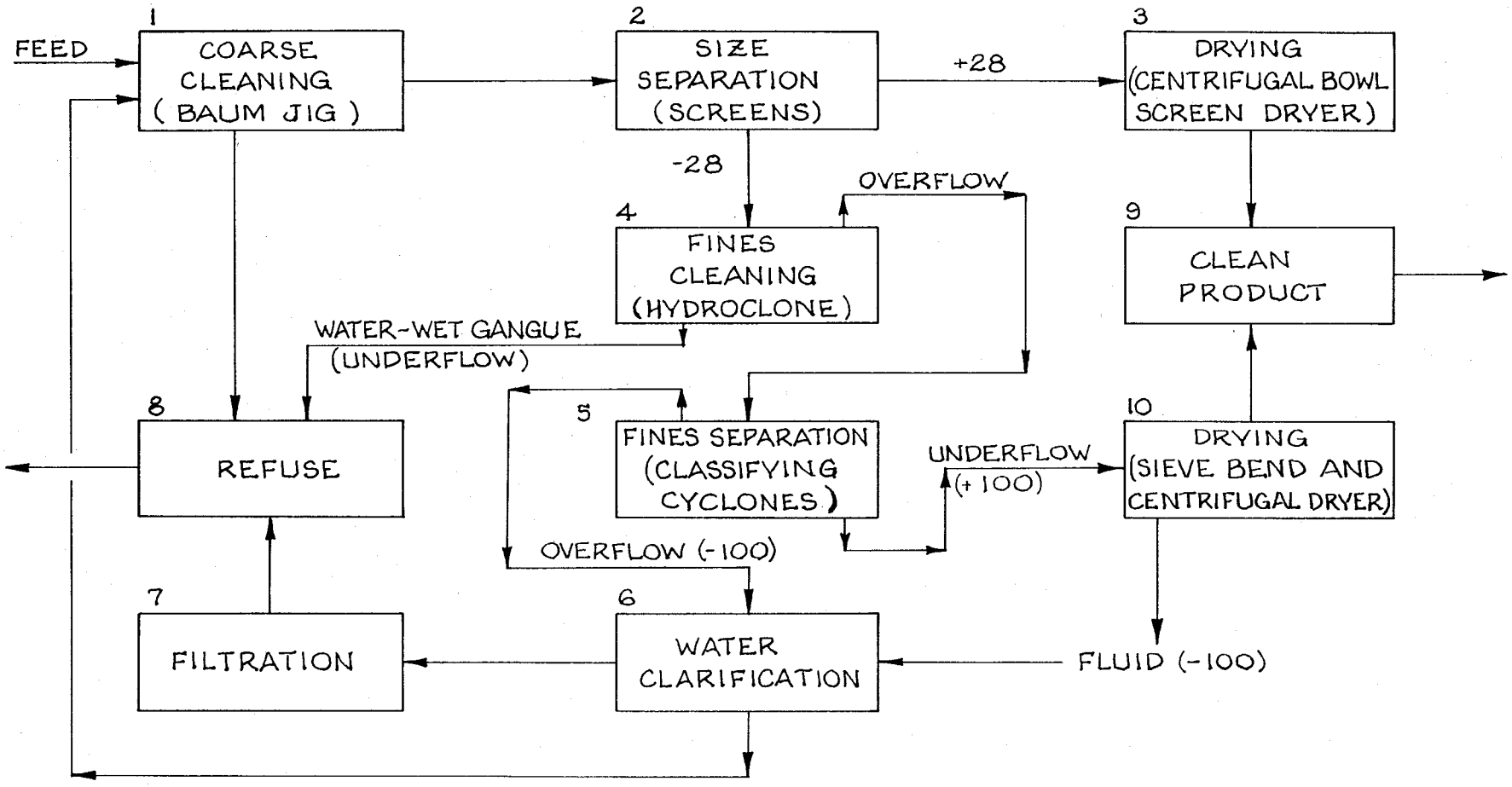
FIG. 1 represents a block diagram of the unit operations to carry out the invention.

In accordance with the present invention, with particular attention to FIG. 1, lignite as mined, including the usual "throwaway" and, in thin veins, including some of the overburden and underlayer, is crushed to 6"×6"×0 and fed to a gravity separator wherein the association with a large body of liquid the clays attendant with the lignite are dispersed releasing the lignite, rocks, etc. as substantially distinct particles. Because of such desolidification of the clays the discrete particles are capable of separation based on their gravity. The gravity separator liquid may be water or a heavy media (e.g. magnetitc and the like) wherein the lignite and the gangue (clays, sandy clay, rock and the like) are separated one from the other. The overflow from this separator provides the main fraction of the lignite while the underflow is largely the rock, clay, sandy clay and the like which is dewatered and used with the overburden to fill the mine digging. The overflow consisting of the main body of the liquid media and most of the lignite, including fines, is submitted to size separation (screened) to recover a product of about +28 mesh of upgraded lignite (freed of substantial association with the clays, rock sandy clays and the like ash producing materials). The product is washed and partially dried and is suitable for use as a fuel for power plants or gasifiers.

The −28 mesh material and most of the liquid medium is forwarded to a fine cleaning step (hydroclones) to produce a lignite overflow and an underflow of gangue (clays, rock and the like). The underflow is sent to the refuse pile. The overflow, the lignite, liquid medium and some fine gangue is subjected to a liquid classification, as in classifier cyclones, to recover most of the lignite, as +100 mesh, as a bottoms product and most of the gangue as an overhead with the liquid medium.

The lignite containing bottoms cut is dewatered as for example on a sieve bend, washed and dried where after it is combined with the +28 mesh product, usually by spray dusting onto the +28 mesh product.

The gangue/liquid medium cut is dewatered and concentrated, as by flocculation thickening and/or filtration, and sent to the refuse pile. While the medium is preferably recycled to the gravity separator.

The resulting product has an average ash content 50% less than the ROM and a BTU content of about 7000 BTU/lb (ROM about 5,500 BTU/lb). The clean lignite represents about 70 wt% of the total ROM and 90% of the BTU's in the ROM.

Having briefly described the invention and with reference to the drawings a more detailed description of a pilot plant will be made.

Figure 2:
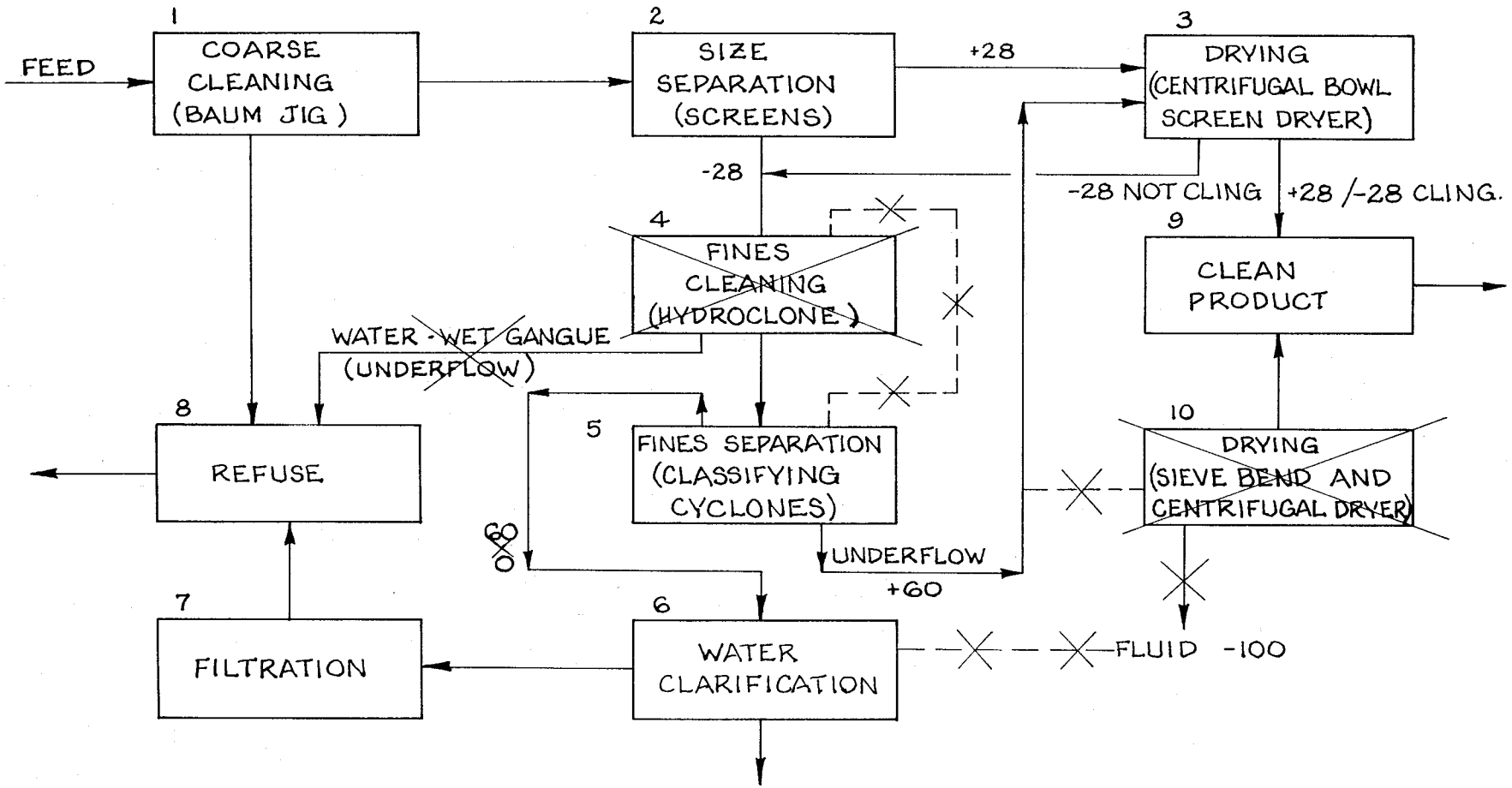
FIG. 2 represents in block diagrams a conventional coal cleaning plant unit operation for comparison with FIG. 1.

A coal cleaning plant assembled from commercially available equipment illustrated in FIG. 2 and was used to acquire data for Example 4.

In a preferred embodiment the unit operations are carried out in a plant as illustrated in FIG. 1.

ROM lignite as brought from an open pit mine is passed through a crusher to reduce the size of the ROM to a two of three dimension size of 6×6 inches and forwarded to a coarse cleaning in a specific gravity separator, such as a Baum jig, Harz, Jeffery, Hancock, Denver jigs and the like. The gangue, the bottoms, is transported to a refuse pile for latter use as fill material in re-landscaping the mine site. The overflow is forwarded to a mechanical screening operation to separate the +28 mesh material from the −28 mesh material. That +28 mesh material is the principal product and is washed and if desired dried. Usually two screens are used per train with the +28 mesh second screen product being combined with the first coarser screen product. The −28 mesh material is sent to a hydroclone wherein the gangue is taken as a liquid media wet bottoms product and sent to the refuse pile.

The overflow from the hydroclone, containing most of the lignite fines and some −100 mesh gangue fines, is classified in a hydro classifier to produce an under flow of +100 mesh lignite fines and an overflow of the −100 mesh gangue and liquid medium. The latter is "dewatered", the wet sludge sent to the refuse pile and the liquid medium returned to the process. The +100 mesh lignite rich solids are "dewatered" on a sieve bend, washed and optionally dried, and preferably sprayed onto the "product" (+28 mesh lignite), thus increasing the lignite recovery.

DETAILED DESCRIPTION OF THE INVENTION

EXAMPLE 1

Freestone County (Texas) ROM lignite was gently agitated with water and it was found that the weight fraction of −100 mesh material increased, on a dry basis, from 4.12 weight percent before treatment to 15.5 wt % following treatment. The ash content of the −100 mesh fraction increased from 63.3 wt% to about 85%. See Table I.

TABLE I

| | TEST PIT NO. 2 FINES ROM | | | |
|---|---|---|---|---|
| | Wt % | % Ash | Btu/lb | % Sulfur |
| | Dry Basis | | | |
| 28 M × 100 | 9.28 | 47.18 | 5864 | .81 |
| 100 M × 0 | 4.12 | 63.37 | 4043 | .72 |

TABLE I-continued

| | TEST PIT NO. 2 FINES ROM | | | |
|---|---|---|---|---|
| | Wt % | % Ash | Btu/lb | % Sulfur |
| | Hydro Degraded | | | |
| 28 M × 100 | 1.6 | 27.09 | 8435 | .79 |
| 100 M × 0 | 15.5 | 84.81 | 1013 | .16 |

EXAMPLE 2

An experiment run in a pilot plant using a Baum Jig shows the degradation to be confined primarily to the non-combustible fraction.

The pilot plant as described in FIG. I was operating on a ROM lignite feed at a rate of 100 tons per hour. The moisture content was 25.39% so the dry feed rate was 74.61 tons/hr. The following particle size distribution (PSD) was determined by dry screening a 55 gallon sample.

TABLE II

| Screen Size Passing | Retained on | WT. % | % Ash |
|---|---|---|---|
| — | 1" | 19.18 | 17.20 |
| 1" | ½" | 14.25 | 20.65 |
| ½" | ¼" | 14.25 | 23.09 |
| ¼" | 28 M | 33.97 | 32.28 |
| 28 M | 100 M | 15.07 | 54.73 |
| 100 M | Pan | 3.29 | 58.49 |

This PSD shows 18.36% (13.7 tons per hour) of −28 mesh material and 3.29% (2.45 tons per hour) of −100 mesh material fed to the plant.

The plant feed was contacted with water in the Baum jig and passed to a screen set which removed the material greater than about 16 mesh. The materials less than about 16 mesh flowed with the water at a rate of 2000 gpm, 5.7% solids and 1.043 specific gravity.

The above conditions calculate to a dry solids flow rate of 29.75 TPH which is 39.87% of the dry material fed to the process. These dry solids had the following PSD.

TABLE III

| Screen Size Passing | Retained on | WT % | % Ash |
|---|---|---|---|
| — | 28 M | 19.05 | 18.16 |
| 28 M | 65 | 12.83 | 27.80 |
| 65 | 100 | 10.03 | 72.36 |
| 100 | 200 | 14.87 | 75.06 |
| 200 | 325 | 5.77 | 75.7 |
| 325 | Pan | 37.45 | |

This test shows a dramatic increase in the fines content on exposure to water but these fines, −325 mesh, are again mostly non-combustible (ash) and being mostly less than 325 mesh fit a clay description. There was 24.08 tons of −28 mesh material and 17.28 tons of −100 mesh material on an hourly basis.

EXAMPLE 3

Experiments were done to establish the technical feasibility of slurry pipeline transport of lignite. They were run on samples of ROM lignite and the same lignite which had been beneficiated by sink-float at 1.6 specific gravity.

When initial attempts were made to prepare slurries with ROM feed in a lab scale rod mill it was found that large amounts of fines were produced with minimal grinding. It was determined that fines generation was due to release and degradation of clays in and on the lignite. Pumpable slurries could be prepared but 35–40% of the solids were extremely fine resulting in higher pumping pressure and dewatering costs. There would be very little control over the grinding process due to variability of the clays in the feed.

Using the beneficiated lignite as process feed it was found that normal grinding times were possible and that slurries acceptable for pipeline transport could be made without usual preparation procedures.

EXAMPLE 4

A full scale washability test was run at commercial coal cleaning plant designed to beneficiate bituminous coal (FIG. 2). The plant was set up to clean the lignite at a specific gravity of 1.55.

1248 tons of Texas lignite were mined from a seam 16 feet thick divided by a 4 foot clay parting. During mining 8 inches of parting and 8 inches of underburden were removed with the lignite. (Such practice simulates thin seam, less than 3 foot seam depth, mining operations). The lignite was transported to a 4 inch roll crusher, crushed to 4" topsize then transported to the cleaning plant. Feed analysis is set forth in Table VII. The test lasted 7½ hours.

Analysis of the jig flow streams shows that about 7% of the Btu's in the feed were lost in the refuse which comprised 23% of the feed (Table IV). Forty-five percent of the ash and 40% of the sulfur was removed from the feed in the jig.

TABLE IV

| | JIG PERFORMANCE (% of Dry Feed) | | | |
|---|---|---|---|---|
| | Feed | Btu's | Ash | Sulfur |
| Cleaned Lignite | 76.9 | 93.2 | 55.3 | 60 |
| Refuse | 23.1 | 6.8 | 44.7 | 40 |

Following initial cleaning in the jig the +28 mesh particles were screened from the stream, the 28 mesh ×0 was fed to the fines circuit where it passes to the cyclone where a 60 mesh size separation was made.

The 28 mesh ×60 mesh material was fed to the centrifugal dryer along with the ¾ inch ×28 mesh coal stream (the +28 screen product) from the dewatering screens. The dryers were equipped with 28 mesh baskets so operation was such that the 28 mesh ×60 mesh particles must cling to large +28 mesh particles to exit the dryer with the clean coal; otherwise, the smaller particles pass through the basket and return to the sump to be recycled. The only other path for this material to leave the circuit was for them to degrade to smaller −60 mesh particles and go to the clarifier.

The 60 mesh ×0 solids and the water therewith was pumped to the thickener, the analysis of the solids therefrom is shown in Table V.

TABLE V

| | THICKENER UNDERFLOW ANALYSIS (Dry) | | |
|---|---|---|---|
| | +100 M | 100 M × 200 M | −200 M |
| Weight % | 8.1 | 7.7 | 84.2 |
| % Ash | 14.3 | 17.9 | 70.8 |
| % Sulfur | .89 | .88 | .42 |
| Btu/lb | 11271 | 10294 | 2989 |

Overall plant performance shows 69% of the ash and 40% of the sulfur removed at a cost of 17% of the Btu's (Table VI).

TABLE VI

| | OVERALL PLANT PERFORMANCE (% of Feed) | | | |
|---|---|---|---|---|
| | Feed (Dry Solids) | Btu's | Ash | Sulfur |
| Cleaned Lignite | 62.8 | 83.3 | 30.8 | 60 |
| Refuse | 37.2 | 16.7 | 69.2 | 40 |

TABLE VII

| | TEST RESULTS | | |
|---|---|---|---|
| | Plant Feed (Dry Basis) | Clean Lignite 62.8% of Feed | % of Feed Recovered in Clean Lignite |
| % Moisture | 27.6 | 33.0 | |
| % Ash | 26.2 (36.3) | 11.9 (17.7) | 30.8 |
| % Sulfur | .8 (1.1) | .7 (1.1) | 60 |
| Btu/lb | 5596 (7733) | 6868 (10255) | 83.3 |

If Texas lignite is washed in such a plant designed for bituminous coal the BTU losses are unacceptable. Even though the flow sheet may be similar it was necessary to assemble the pilot plant in such a way that the lignite losses were avoided and refuse handling was facilitated. For example, the refuse belt in the commercial plant became plugged with clay when lignite was run. This and other trouble spots required changes in the operating procedures and unit operations in the pilot plant in order to reduce lignite losses and increase the BTU content of the product recovered.

TABLE VIII

| | Average Feed | Average Product | % of Feed Recovered in Clean Lignite |
|---|---|---|---|
| % Moisture | 27.8 | 33.1 | |
| % Ash | 27.7 (40.93) | 11.4 (17.04) | 27.89 |
| % Sulfur | .89 (1.25) | 0.80 (1.19) | 61.01 |
| BTU/lb | 5498 (7276) | 7024 (10499) | 86.10 |

Figure 3:
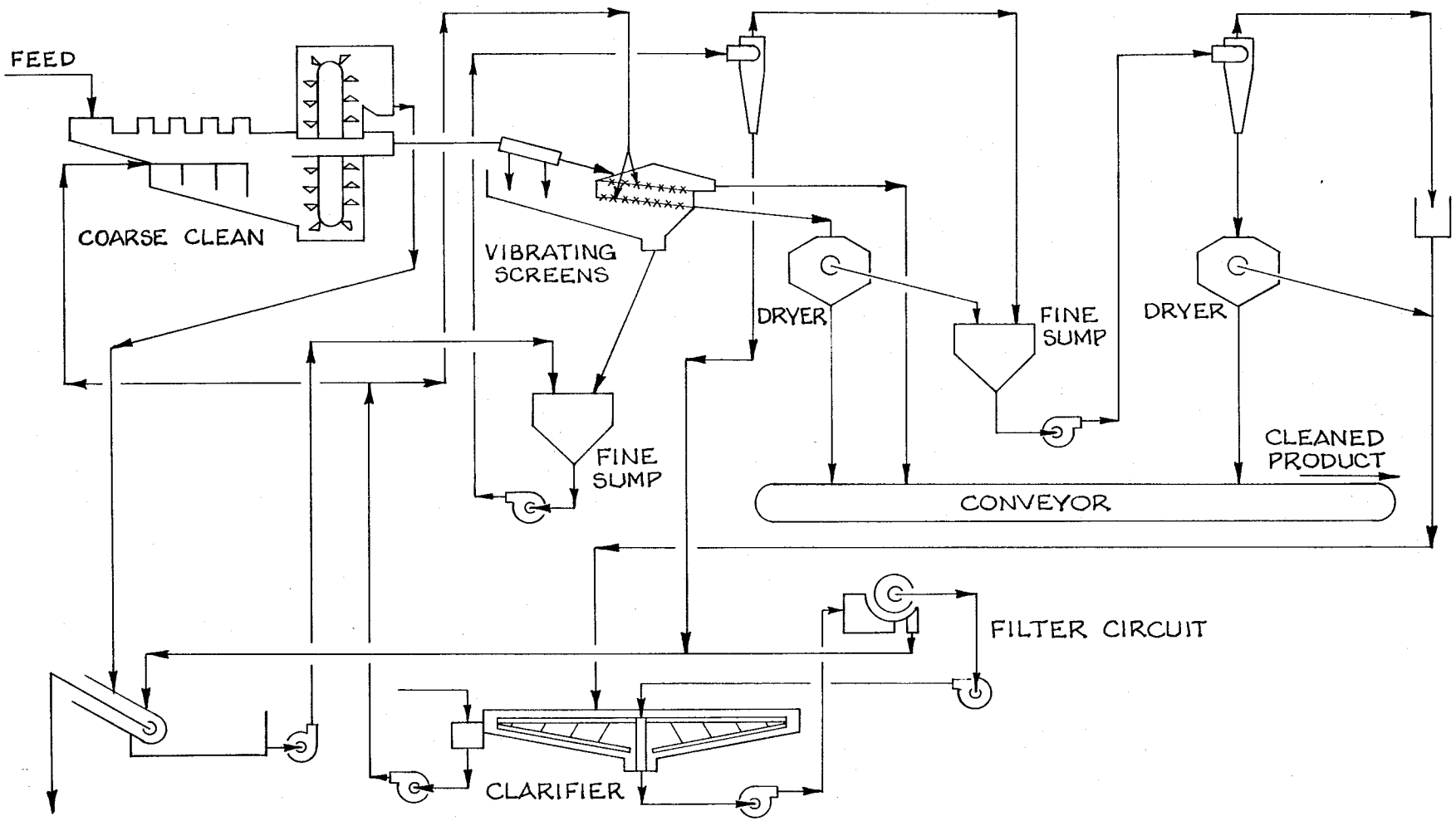
FIG. 3 illustrates a commercial plant employed to obtain data for Example 5.

A pilot plant configured essentially as in FIGS. 1 and 3 was operated for a period of 3 months cleaning Texas lignite. The feed and product averages for the period are shown in Table VIII.

Comparison of the data in Tables VI and VII shows that the pilot plant (FIG. 1) produced higher quality lignite at a higher BTU recovery than was produced in the plant designed to clean sub-bituminous coal (FIG. 2).

What is claimed is:

1. A process for upgrading lignite ores to remove a substantial proportion of the non-combustible ash content associated with the lignite which comprises:
   (1) sizing by crushing to a maximum top size of less than about 6 inches in two directions (axis's)
   (2) separating the clay and/or rock (gangue) which are discarded and lignite from each other in a float-sink gravity separator,
   (3) directing the float containing the lignite and some small particles of clays to a screen deck to size the float into at least three portions,
   (4) washing the first two screen proportions to free them of clays,
   (5) collecting the third portion consisting of fines and water as an underflow from said deck, (6) treating the underflow in a hydrocyclone to recover a substantial quantity of the lignite associated with some clays as the overflow and an aqueous stream containing the remainder of the clays and some lignite as the underflow and discarding.

(7) treating overflow to effectuate a size separation of the lignite substantially free of clays as underflow and the clays with some fine lignites as the overflow.

(9) seive bend dewatering and washing and drying the underflow and combining the resultant product with the +28 mesh lignite product,

(10) flocculating (clarifier-thickener) the refuse from the seive bend and the overflow from (7) to about 35% solids,

(11) further concentrating the refuse, as by filtration, to a discardable solid.

* * * * *